US010723595B2

(12) United States Patent
Behnke

(10) Patent No.: US 10,723,595 B2
(45) Date of Patent: Jul. 28, 2020

(54) METHOD FOR OPERATING AT LEAST TWO LIFTING MEANS IN A GROUP OPERATION, AND ASSEMBLY COMPRISING AT LEAST TWO LIFTING MEANS

(71) Applicant: Konecranes Global Corporation, Hyvinkää (FI)

(72) Inventor: Klaus Behnke, Dortmund (DE)

(73) Assignee: Konecranes Global Corporation, Hyvinkää (FI)

( * ) Notice: Subject to any disclaimer, the term of this patent is extended or adjusted under 35 U.S.C. 154(b) by 169 days.

(21) Appl. No.: 15/769,185

(22) PCT Filed: Oct. 21, 2016

(86) PCT No.: PCT/EP2016/075437
§ 371 (c)(1),
(2) Date: Apr. 18, 2018

(87) PCT Pub. No.: WO2017/072051
PCT Pub. Date: May 4, 2017

(65) Prior Publication Data

US 2018/0319633 A1 Nov. 8, 2018

(30) Foreign Application Priority Data

Oct. 28, 2015 (DE) ..... 10 2015 118 434

(51) Int. Cl.
*B66C 13/18* (2006.01)
*B66C 13/08* (2006.01)
(Continued)

(52) U.S. Cl.
CPC ..... *B66C 13/18* (2013.01); *B66C 13/08* (2013.01); *B66C 13/16* (2013.01); *B66C 13/22* (2013.01);
(Continued)

(58) Field of Classification Search
None
See application file for complete search history.

(56) References Cited

U.S. PATENT DOCUMENTS 5,893,471 A * 4/1999 Zakula ..... B66C 13/08 212/316
6,382,437 B1 * 5/2002 Okada ..... B66C 13/06 212/274
(Continued)

FOREIGN PATENT DOCUMENTS

CN 102770365 A 11/2012
CN 204474164 U 7/2015
(Continued)

OTHER PUBLICATIONS

Preliminary Report on Patentability of the International Searching Authority in English from corresponding Patent Cooperation Treaty (PCT) Application No. PCT/EP2016/075437, completed May 1, 2018.
(Continued)

*Primary Examiner* — Dale W Hilgendorf
*Assistant Examiner* — Alexander C. Bost
(74) *Attorney, Agent, or Firm* — Gardner, Linn, Burkhart & Ondersma LLP

(57) ABSTRACT

A method and assembly for operating at least two lifting gears in a group operation, where each lifting gear has a hoist via which a respective cable or chain can be raised or lowered. The hoists are first operated in a synchronous operating mode to perform a common lifting procedure to move a load supported by the hoists. At least one of the hoists involved in the common lifting procedure is then deactivated to switch from the synchronous operation into an individual operation or a multi-operation, with at least one of the hoists remaining activated to carry out a lifting or lowering process relative to each deactivated hoist. A load
(Continued)

value is then determined for the at least one deactivated hoist and compared to a predetermined threshold value of the at least one deactivated hoist.

17 Claims, 1 Drawing Sheet

(51) Int. Cl.

| | |
|---|---|
| ***B66C 13/22*** | (2006.01) |
| ***B66C 13/40*** | (2006.01) |
| ***B66C 15/06*** | (2006.01) |
| ***B66C 13/16*** | (2006.01) |
| ***B66C 15/00*** | (2006.01) |

(52) U.S. Cl.
CPC ..... *B66C 13/40* (2013.01); *B66C 15/00* (2013.01); *B66C 15/065* (2013.01)

(56) References Cited

U.S. PATENT DOCUMENTS

| | | | | |
|---|---|---|---|---|
| 6,598,859 | B1 | 7/2003 | Kureck et al. | |
| 6,837,363 | B2 * | 1/2005 | Munzebrock | G05B 9/03 198/502.1 |
| 7,451,883 | B2 * | 11/2008 | Wierzba | B66C 13/18 212/316 |
| 7,517,183 | B2 * | 4/2009 | Waisanen | B66C 13/06 212/330 |
| 8,226,137 | B2 * | 7/2012 | Kasper | B66C 11/06 254/358 |
| 10,108,164 | B2 * | 10/2018 | Stagg | G06Q 10/06 |
| 2005/0098768 | A1 * | 5/2005 | Malek | B66C 15/065 254/267 |
| 2006/0102578 | A1 * | 5/2006 | Zakula, Sr. | B66C 13/22 212/283 |
| 2007/0095777 | A1 * | 5/2007 | Wierzba | B66C 11/04 212/345 |
| 2008/0053945 | A1 * | 3/2008 | Schneider | B66C 15/045 212/276 |
| 2010/0243594 | A1 * | 9/2010 | King | B66C 15/045 212/276 |
| 2013/0112643 | A1 * | 5/2013 | Lecours | B66C 13/18 212/276 |
| 2014/0224755 | A1 * | 8/2014 | Eriksson | B66C 13/06 212/273 |
| 2014/0251935 | A1 * | 9/2014 | Behnke | B66C 13/18 212/285 |
| 2015/0076100 | A1 * | 3/2015 | Ellicott | B66C 15/065 212/278 |
| 2015/0203334 | A1 * | 7/2015 | Moran | B66C 13/063 212/276 |
| 2015/0203336 | A1 * | 7/2015 | Chou | B66C 17/00 212/276 |
| 2015/0360918 | A1 * | 12/2015 | Ko | B66C 13/12 212/276 |
| 2016/0031683 | A1 * | 2/2016 | Fenker | B66C 13/40 212/276 |

FOREIGN PATENT DOCUMENTS

| | | | |
|---|---|---|---|
| DE | 2924070 | A1 | 11/1980 |
| DE | 3147158 | A1 | 6/1983 |
| DE | 102006040782 | A1 | 3/2008 |
| DE | 102007019959 | B3 | 7/2008 |
| DE | 102011053014 | A1 | 2/2013 |
| FR | 2669317 | A1 | 5/1992 |
| JP | H05208792 | A | 8/1993 |

OTHER PUBLICATIONS

International Search Report of the International Searching Authority from corresponding Patent Cooperation Treaty (PCT) Application No. PCT/EP2016/075437, indicated completed on Jan. 18, 2017.

Written Opinion of the International Searching Authority from corresponding Patent Cooperation Treaty (PCT) Application No. PCT/EP2016/075437, indicated completed on Jan. 18, 2017.

* cited by examiner

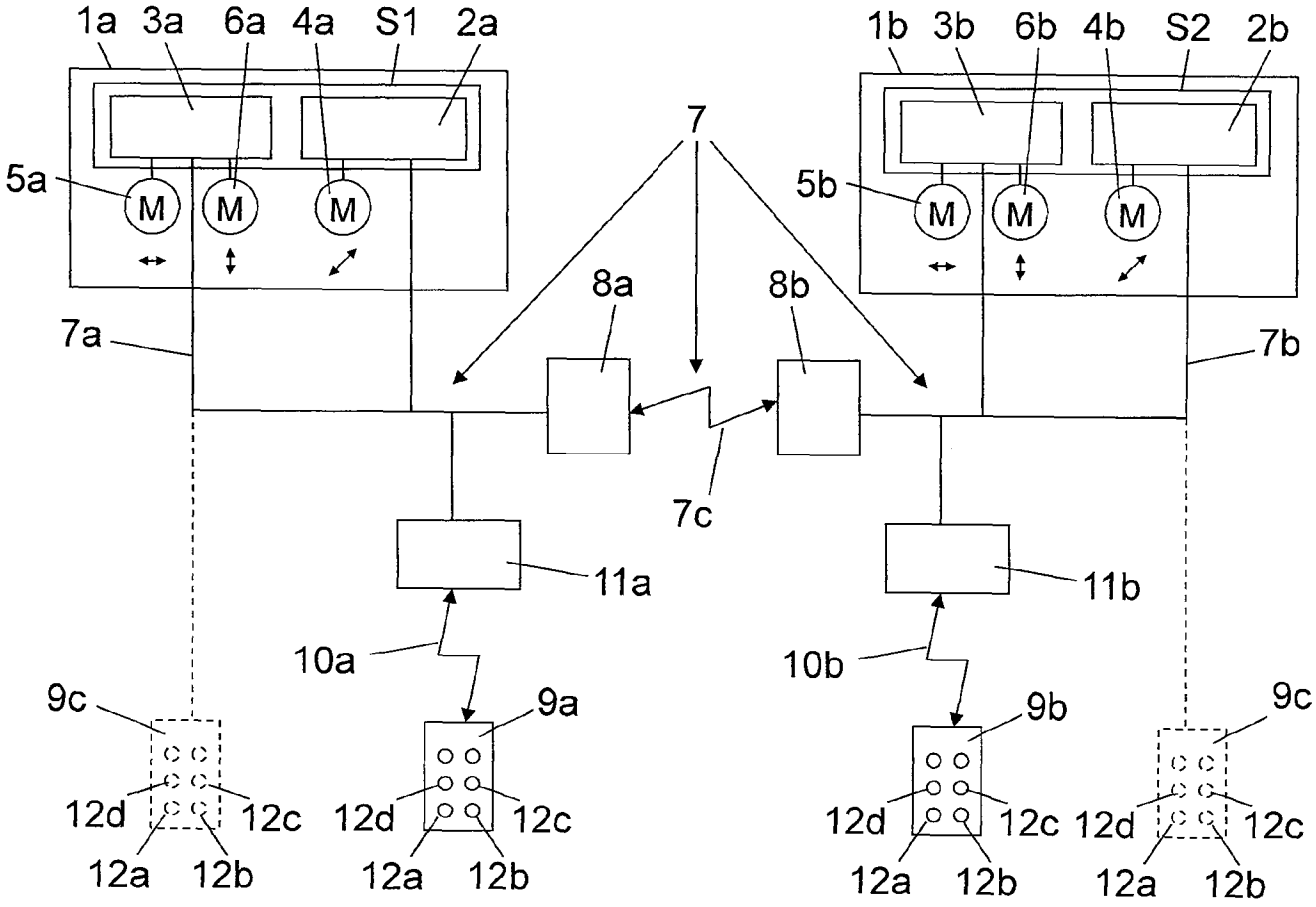
1a
2a
S1
3a
4a
6a
5a
7a
8a
11a
10a
9a
9c
12a
12b
12c
12d
7
7c
8b
11b
10b
9b
1b
2b
S2
3b
4b
6b
5b
7b
M

METHOD FOR OPERATING AT LEAST TWO LIFTING MEANS IN A GROUP OPERATION, AND ASSEMBLY COMPRISING AT LEAST TWO LIFTING MEANS

CROSS REFERENCE TO RELATED APPLICATIONS

The present patent application claims the priority benefits of International Patent Application No. PCT/EP2016/075437, filed Oct. 21, 2016, and claims benefit of German patent application DE 10 2015 118 434.6, filed Oct. 28, 2015.

BACKGROUND OF THE INVENTION

The invention relates to a method for operating at least two lifting gears in a group operation, wherein each lifting gear has a hoist, via which a respective load picking-up means can be raised by a lifting procedure or can be lowered by a lowering procedure, in which group operation, in a synchronous operating mode, firstly a common lifting procedure is carried out by means of the at least two hoists in order to move a load fastened to the load picking-up means, after the common lifting procedure, for changing from the synchronous operation to an individual operation or a multi-operation, at least one of the hoists involved in the common lifting procedure is deactivated, and at least one of the involved hoists remains activated such that only each activated hoist can carry out a lifting procedure or lowering procedure relative to each deactivated hoist.

The invention also relates to an assembly comprising at least two lifting gears.

German laid-open document DE 10 2011 053 014 A1 describes a method for operating at least two lifting gears in a normal operation and in a group operation. Within the group operation, a tandem operation is possible, in which via a single control switch the hoists of both cranes can be operated synchronously and in this case can also be moved horizontally. Within the group operation, it is also possible to perform an individual operation, in which the cranes and in particular their hoists and load picking-up means can be moved individually relative to one another.

The tandem operation can cause critical operating states, such as e.g. an oblique position of the load, which require an individual operation for this to be rectified. Since in this case the distribution of the load to the hoists and load picking-up means supporting the load is changed, this can result in the hoist, which is deactivated for the individual operation, becoming overloaded and consequently can result in a load crashing down.

It is known that hoists have an overload safety device comprising a load sensor which determines a load value corresponding to a load acting upon the hoist during a lifting procedure, the determined load value is compared to a permissible threshold value and the lifting procedure is prevented if the determined load value exceeds the threshold value. However, such an overload safety device which detects and monitors hoists which are active merely during a lifting procedure, cannot detect the overloading of a deactivated hoist and cannot prevent an imminent crash of the load.

It is known from German laid-open document DE 31 47 158 A1 to prevent an oblique position of the load in the case of two crane hoists operated in a tandem operation. For this purpose, a sensor is arranged on a load cross-beam which is suspended on load picking-up means of the two crane hoists, said sensor being used to determine and evaluate the position of the load cross-beam. Since a hoist which is deactivated after the tandem operation can be overloaded even without a detectable oblique position of the load, an imminent crash of the load also cannot be reliably prevented by such a sensor.

It is known from German load-open document DE 10 2006 040 782 A1 to operate two rotary luffing cranes in each case in a normal operation and in this case to coordinate their mutually independent movements in order to be able to move a common load with both cranes. This is referred to as tandem operation in said document. A synchronous operation of the two cranes which is effected via a single control switch is not performed in this case. Instead, in a manner which is typical of a normal operation the controllers of the two cranes are active so that the crane operator of each crane can instigate movements of his crane. In this case, the overload safety devices of both cranes are integrated in order to ensure that movements of the first crane do not cause any overload states in the other crane. The movements of the rotary mechanism and of the luffing mechanism which are instigated by the respective crane operators in this coordinated normal operation are not carried out if one of the overload safety devices detects an overload. It is also described that the controller of one crane can be deactivated and the rotary mechanism and the luffing mechanism of this crane can be controlled from another crane.

SUMMARY OF THE INVENTION

The present invention provides a method for operating at least two lifting gears in a group operation and provides a correspondingly operable assembly comprising at least two lifting gears which are particularly secure.

In a method for operating at least two lifting gears in a group operation, wherein each lifting gear has a hoist, via which a respective load picking-up means can be raised by a lifting procedure or can be lowered by a lowering procedure, in which group operation, in a synchronous operating mode, firstly a common lifting procedure is carried out by means of the at least two hoists in order to move a load fastened to the load picking-up means, after the common lifting procedure, for changing from the synchronous operation to an individual operation or a multi-operation, at least one of the hoists involved in the common lifting procedure is deactivated, and at least one of the involved hoists remains activated such that only each activated hoist can carry out a lifting procedure or lowering procedure relative to each deactivated hoist, which method is particularly safe, provision is made that even after changing from the synchronous operation to the individual operation or the multi-operation for each hoist previously involved in the common lifting procedure of the synchronous operation, in particular each deactivated hoist, a load value corresponding to a partial load acting upon the hoist is determined and compared to a respectively permissible threshold value. In this manner, it is possible to detect whether, in the individual operation or multi-operation planned after the synchronous operation, an overload of the at least one deactivated hoist and thus a load crash are imminent. If an overload is detected, the appropriate reaction can be implemented and the operation can revert e.g. to the synchronous operation and the load can be lowered in the synchronous operation of the at least two lifting gears. Moreover, the method is particularly practical and can be easily applied by implementing corresponding software routines without additional outlay for hardware. This makes it possible to adapt the method flexibly to the changes in the permissible loading conditions which occur during the operational sequence. In particular, it is not necessary to provide an additional, costly and complex programmable controller in the sense of a safety programmable logic controller.

The lifting gears are operated together in the synchronous operation via a single control switch, in particular in a synchronous manner and thus in parallel and co-rotating in terms of rectified movements at the same speed. Counter-rotating or rectified movements at different speeds are not provided in the synchronous operation. Therefore, the synchronous operation differs from a coordinated normal operation of two lifting gears, in which the lifting gears are likewise operated at the same time but the activation is effected independently of one another via two control switches and not in terms of the synchronous operation via a single control switch. In the case of a coordinated normal operation of two lifting gears, counter-rotating movements at different speeds of the two lifting gears are also possible. Further explanations relating to the synchronous operation and other stated operating modes can be found in the description hereinafter.

Moreover, provision is advantageously made that the lifting procedure or the lowering procedure of each activated hoist is prevented if, in the case of the at least one deactivated hoist, a load value is determined which exceeds a permissible threshold value. This further increases the level of safety because a lifting or lowering procedure is not possible when the at least one deactivated hoist is overloaded.

A further increase in safety can be achieved by virtue of the fact that for each hoist load values are continuously determined and compared to a respectively permissible threshold value. In this manner, it is possible to achieve continuous overload protection.

In an advantageous manner, provision is made that for each hoist, the involvement in the synchronous operation, in particular in the common lifting procedure, is stored and, after the change to the individual operation or multi-operation by a controller of the at least one activated hoist, the respectively determined load values and threshold values of all of the hoists originally involved in the synchronous operation are compared using this information.

In a structurally simple manner, provision is made that each hoist can be moved in at least one horizontal direction by a travel procedure independently of the lifting or lowering procedure and the travel procedure of each activated hoist is prevented if, in the case of the at least one deactivated hoist, a load value is determined which exceeds a permissible threshold value. As a result, the above advantages are also effective for more complex load handing situations.

In an advantageous manner, provision is made that the threshold value can vary in dependence upon different operating situations and can be set in particular in a controller of the respective hoist. This makes it possible to configure the method in a particularly flexible manner for a wide variety of load handling situations.

In a structurally simple manner, provision is made that each lifting gear is designed as a crane comprising a crane girder, in particular as a bridge crane.

The safety of an assembly comprising at least two lifting gears, in particular two cranes, can be increased by virtue of the fact that the lifting gears and in particular the controllers thereof are designed in order to be able to be operated according to one of the previously described methods.

The invention will be explained in greater detail hereinafter with reference to an exemplified embodiment illustrated in the drawing.

BRIEF DESCRIPTION OF THE DRAWINGS

FIG. 1 shows a schematic view of two bridge cranes connected together for a group operation.

DESCRIPTION OF THE PREFERRED EMBODIMENTS

FIG. 1 schematically illustrates an assembly comprising two lifting gears. The lifting gears are formed by a first crane 1*a* and a second crane 1*b*, or are part of the respective crane 1*a*, 1*b*. Each crane 1*a*, 1*b* typically has a horizontal crane girder. Arranged on each crane girder is a crane trolley which supports a hoist and can be moved together therewith in the direction of the longitudinal extension of the crane girder (not illustrated). The first and second crane 1*a*, 1*b* are each designed as a bridge crane. Accordingly, each crane girder can be moved together with the crane trolley supporting the hoist along crane rails, not illustrated, in the direction transverse to its longitudinal extension. The first crane 1*a* has a first controller S1 which comprises a first crane controller 2*a* and a first trolley controller 3*a*. The second crane 1*b* correspondingly has a second controller S2 which comprises a second crane controller 2*b* and a second trolley controller 3*b*. The first and second crane controller 2*a*, 2*b* are each operable to activate the first and second crane travel motors 4*a*, 4*b* in order to move the respective crane girder along the crane rails. By means of the first and second trolley controller 3*a*, 3*b*, first and second trolley travel motors 5*a*, 5*b* are activated in order to move the respective crane trolley along the crane girder. Moreover, first and second hoist motors 6*a*, 6*b* are activated via the first and second trolley controller 3*a*, 3*b* in order in each case to activate the associated hoist arranged on the corresponding crane trolley and to respectively raise and lower a load picking-up means thereby. The hoists which are allocated to the hoist motors 6*a*, 6*b* and are not illustrated are designed as cable pulls. Basically, it is also possible to design the hoists as chain pulls. Mixed operation of chain pulls and cable pulls is also feasible. The aforementioned motors 4*a*, 4*b*, 5*a*, 5*b*, 6*a* and 6*b* are designed as electric motors.

In order to be able to transmit and receive operating signals and safety signals, the crane controllers 2*a*, 2*b* and the trolley controllers 3*a*, 3*b* are each connected to a bus 7 via bus coupling modules, not illustrated. This bus 7 operates preferably with the CAN protocol. Moreover, the bus 7 is constructed from a first wired bus portion 7*a* locally in the region of the first crane 1*a*, from a second wired bus portion 7*b* locally in the region of the second crane 1*b* and from a wireless bus 7*c* which connects the first bus portion 7*a* and the second bus portion 7*b* together. For this purpose, a first coupling module 8*a* is connected to the first bus portion 7*a* and a second coupling module 8*b* is connected to the second bus portion 7*b*. By means of the coupling modules 8*a*, 8*b*, the signals on the first bus portion 7*a* and the second bus portion 7*b* are converted into wireless signals and are transmitted via transmitter and receiver devices between the coupling modules 8*a*, 8*b*. Therefore, all of the bus participants, such as the crane controllers 2*a*, 2*b*, the trolley controllers 3*a*, 3*b* and also directly or indirectly the first and the second control switch 9*a*, 9*b* are connected to a common bus 7 by means of the coupling modules 8*a*, 8*b*. Preferably, the wireless bus 7*c* is designed as a radio communication bus. It is also possible to provide an infrared bus.

The crane controllers 2*a*, 2*b* and the trolley controllers 3*a*, 3*b* are provided with power switches, safety switches, sensors, switching logic and bus coupling modules which are not illustrated and are generally known. The bus coupling modules can be a component of the switching logic.

Also provided are a first wireless control switch 9*a* which is allocated to the first crane 1*a*, and a second wireless control switch 9*b* which is allocated to the second crane 1*b*. The control switch 9*a* is connected to a first switch coupling module 11*a* via a first wireless connection 10*a*. The wireless connection 10*a* is bidirectional. The same applies to the second control switch 9*b*, to which a second wireless connection 10*b* and a second switch coupling module 11*b* are allocated. The first switch coupling module 11*a* and the second switch coupling module 11*b* are connected to the bus 7 as further bus participants. The control switch 9*a*, 9*b* are typically equipped with a multiplicity of button switching elements in order to activate the individual movement directions and possibly present speed stages of the crane travel motors 4*a*, 4*b*, the trolley travel motors 5*a*, 5*b* and the hoist motors 6*a*, 6*b*. In this manner, each hoist can be moved as part of a travel procedure by means of the crane travel motors 4*a*, 4*b* and/or the trolley travel motors 5*a*, 5*b* in a horizontal direction, i.e. in the crane travel direction and the crane travel direction at a right angle thereto, and therefore in particular in a horizontal plane and, independently thereof, each load picking-up means is raised via the hoist motors 6*a*, 6*b* as part of a lifting procedure or is lowered as part of lowering procedure operated in reverse thereto.

Alternatively, instead of providing the two wireless control switches 9*a*, 9*b* and the two switch coupling modules 11*a*, 11*b*, it is possible to provide cable control switches 9*c*, as indicated by the broken lines in FIG. 1. The cable control switches 9*c* are designed as pendant switches and are connected to the bus 7 as bus participants directly via their supply line in order to assume the functions of the control switches 9*a*, 9*b*.

The previously described cranes 1*a* and 1*b* can each be operated individually and independently of one another via the associated control switch 9*a* or 9*b* in order to move the respective load picking-up means and optionally a load fastened thereto. This operating mode will be referred to hereinafter as normal operation. Then, within the normal operation, the first control switch 9*a* is allocated to the first crane 1*a* and activated and the second control switch 9*b* is allocated to the second crane 1*b* and activated. Therefore, in the normal operation both control switches 9*a*, 9*b* are in an active state.

It is also possible to log-on the two cranes 1*a*, 1*b* for a so-called group operation, in which the cranes 1*a*, 1*b* are connected together in terms of control such that they are coordinated via a single control switch 9*a* or 9*b* and in this case can be operated in particular together in a synchronous manner and thus in parallel and co-rotating in a synchronous operation defined in greater detail below, or can even be operated individually and independently of one another and relative to one another in an individual operation defined in greater detail below. In the group operation, a load to be moved is picked up by load picking-up means of all of the hoists, which are involved in the group operation, of the cranes 1*a*, 1*b* logged-on for this purpose. In this case, more than one load picking-up means can also be provided for each hoist. This makes the group operation particularly suitable if a long and/or heavy load is to be moved and in this case in particular is not only to be raised or lowered and moved translationally in a horizontal direction but is also to be rotated and this is no longer possible in a normal operation using a single crane 1*a* or 1*b*.

In order to be able to alternate between the normal operation and the group operation, in each case a button switching element is formed as a log-on button 12*a* and a button switching element is formed as a log-off button 12*b* on both control switches 9*a*, 9*b*. Instead of specific log-on and log-off buttons 12*a*, 12*b*, a predetermined actuating sequence of button switching elements can also trigger the change between the normal operation and the group operation.

By actuating the log-off button 12*b* of one of the two control switches 9*a* or 9*b*, the control switch is deactivated in a first step and by changing it to the passive state a termination of the normal operation is triggered. At the same time, an enable signal is sent to the bus 7 and in the direction of the first controller S1 and the second controller S2 or the crane controllers 2*a*, 2*b* included therein and the trolley controllers 3*a*, 3*b* to ensure that the crane 1*a* or 1*b* associated with the deactivated control switch 9*a* or 9*b* is available for a group operation and can be incorporated therein.

In addition, the emergency stop button can also be pressed preferably for the actuation of the log-off button 12*b* or can be logged-off at the end of an actuating sequence. Therefore, at the control switch 9*a*, 9*b* it is also possible to visually recognise from the pressed emergency stop switch that this control switch 9*a*, 9*b* is in the passive state and is available for a group operation.

In order to log-on and finally configure the group operation, the log-on button 12*a* of the control switch 9*a* or 9*b* which is still in the active state must be actuated in a second step. As a result, a signal is sent via the bus 7 in the direction of the first controller S1 and the second controller S2 and a setting is implemented to ensure that the still activated control switch 9*a* or 9*b* is now accepted both by the first controller S1 and the second controller S2 or all crane controllers 2*a*, 2*b* and trolley controllers 3*a*, 3*b* included therein as a source of control and safety signals.

In this manner, the crane 1*a* or 1*b* which, in the above first step, is enabled for the group operation is logged-on or is incorporated into the group operation. The configuration of the group operation thus requires both previously described steps in terms of an acknowledgement procedure. Alternatively, a reverse sequence of the two steps is also possible. Accordingly, the log-on button 12*a* can initially be actuated as a request for involvement in the group operation, which must be confirmed by actuation of the log-off button 12*b*.

In order to terminate the group operation, the log-off button 12*b* is actuated at the single activated control switch 9*a* or 9*b*. A corresponding log-off signal is sent via the bus 7 to the crane controllers 2*a*, 2*b* and the trolley controllers 3*a*, 3*b*. Optionally, in the case of the control switch 9*a* or 9*b* which was previously in the passive state, the emergency stop button is deactivated and the log-on button 12*a* is actuated. Also, provision can be made that the deactivated control switch 9*a* or 9*b* is only activated and thus a change to the normal operation can be made when none of the button switching elements of this control switch 9*a* or 9*b* is actuated. A corresponding log-on signal of the previously deactivated control switch 9*a* or 9*b* is sent automatically or by actuating a corresponding button switching element via the bus 7 to the crane controllers 2*a*, 2*b* and the trolley controllers 3*a*, 3*b*. Both control switches 9*a*, 9*b* and the associated cranes 1*a* and 1*b* are then in the state of normal operation. The termination of the group operation thus requires the two previously described steps in reverse order in terms of an acknowledgement procedure. Therefore, the two cranes 1*a*, 1*b* are operationally separated from one another but continue to be connected to one another via the bus 7 in order to be able to react to a future request of a new group operation.

In conjunction with the log-on and log-off sequences for alternating between normal and group operation and vice versa, the steps of deselecting one of the two control switches 9*a*, 9*b*, which has followed on from the log-on by the other one of the two control switches 9*a*, 9*b*, are monitored, detected, controlled and checked for permissibility by the crane controllers 2*a*, 2*b* and the trolley controllers 3*a*, 3*b*. For this purpose, the crane controllers 2*a*, 2*b* and the trolley controllers 3*a*, 3*b* are interchanged with one another. Only log-off and log-on sequences in a previously determined manner, e.g. after the aforementioned two steps, are taken into account and even the sequence of the steps of deselecting and logging-on are checked in order to ensure a safe change between normal operation and group operation. This results in a high level of safety. In the crane controllers 2*a*, 2*b* and the trolley controllers 3*a*, 3*b*, the log-off and log-on sequences are pre-set so that a corresponding detection, check and at the end the actual change between normal and group operation can be effected in the crane controllers 2*a*, 2*b* and the trolley controllers 3*a*, 3*b* as soon as the correct sequence and type of log-off and log-on sequences has been detected.

In the group operation, only the first control switch 9*a* or only the second control switch 9*b* is in an active state and the remaining control switch 9*a* or 9*b* is in a passive state. In the passive state, the corresponding control switch 9*a* or 9*b* is deactivated and therefore is prevented from being operated. Accordingly, all of the actuations of button switching elements which are performed on the deactivated control switch 9*a* or 9*b* and are directed at triggering a travel procedure, lifting procedure or lowering procedure are ignored. This prevents the bus 7 from being subjected to related control commands in the form of corresponding control signals or prevents these control commands from being executed by the controllers S1 and S2. In other words, the control switch 9*a* or 9*b* which is deactivated and is in the passive state cannot trigger a travel procedure, lifting procedure or lowering procedure. This and also any coordination of the cranes 1*a*, 1*b* involved in the group operation above and beyond this is only possible via the single activated control switch 9*a* or 9*b* in the active state. The first controller S1 and the second controller S2 are correspondingly set in the group operation.

Within the group operation which includes two cranes 1*a* and 1*b*, two operating modes are possible and in particular a synchronous operation and an individual operation. The operating mode is selected by actuating one of the button switching elements of the activated control switch 9*a* or 9*b* which is used accordingly as a selection button 12*c*. In dependence upon the selected operating mode, the cranes 1*a* and 1*b* react differently to the control signals sent by the activated control switch 9*a* or 9*b* to the bus 7.

A synchronous operation which, as in the present exemplified embodiment, is performed using two cranes 1*a*, 1*b* is also referred to as a tandem operation. In the synchronous operation, the single activated control switch 9*a* or 9*b* is allocated at the same time to all of the cranes logged-on to the group operation, thus in the present case the two cranes 1*a*, 1*b*, such that the motors 4*a*, 4*b*, 5*a*, 5*b*, 6*a* and 6*b* react in parallel to the control signals sent by the activated control switch 9*a* or 9*b* and execute the corresponding control commands. By reason of the parallel activation of the crane travel motors 4*a*, 4*b*, trolley travel motors 5*a*, 5*b* and hoist motors 6*a*, 6*b*, the motors 4*a*, 4*b*, 5*a*, 5*b*, 6*a* and 6*b* of the first crane 1*a* and of the second crane 1*b* move together and synchronously, thus giving rise to a co-rotating travel procedure and/or lifting procedure or lowering procedure.

Within the group operation and in particular within the synchronous operation, critical operating states can occur, in which the synchronous and parallel operation of the motors 4*a*, 4*b*, 5*a*, 5*b*, 6*a* and 6*b* must be interrupted in order to then be resumed shortly thereafter or at a later stage. This can be the case if, by reason of the movement of the two cranes 1*a*, 1*b* in the synchronous operation the load moves into an undesired and instable oblique position, in which e.g. in the case of load picking-up means having eyes, there is a threat of the load sliding out and crashing. Even in the case of a load in the form of a container, which includes a bulk material, in the synchronous operation the bulk material can slide resulting in an instable oblique position of the container. In each case, this makes it necessary to perform a rotational change or correction of the position of the load in order to correct the oblique position and restore a stable horizontal orientation of the load. A correction of the relative position of the cranes 1*a*, 1*b* with respect to one another, in particular the crane girders thereof and/or the crane trolleys thereof supporting the respective hoist, is also feasible in this regard. This can also be necessary when the load is not in an oblique position.

For such corrections, actuation of the selection button 12*c* changes the operation from the synchronous or tandem operation to an individual operation. In this case, there is no departure from the group operation. Accordingly, in the individual operation only one of the control switches 9*a* or 9*b* remains in the active state and the other control switch 9*a* or 9*b* remains deactivated in the passive state. Moreover, for the individual operation one of the two cranes 1*a*, 1*b* is deactivated and therefore are set to a passive state so that only one of the two cranes 1*a*, 1*b* remains activated. The coordination, i.e. the selection and deactivation of the respective crane 1*a* or 1*b* is effected via the activated control switch 9*a*, 9*b* by the actuation of a corresponding button switching element. In this case, the selection of the respectively activated or deactivated crane 1*a* or 1*b* can also be changed via the activated control switch 9*a*, 9*b*.

The respectively deactivated crane 1*a* or 1*b* then ignores at least such control signals or does not execute the corresponding control commands which are directed at triggering a travel procedure, lifting procedure or lowering procedure. In contrast, control signals which are directed at reactivating the deactivated crane 1*a* or 1*b* in order to change to the synchronous operation are not ignored. The deactivation of one of the two cranes 1*a* or 1*b* thus causes only the other one of the two cranes 1*a*, 1*b* to remain as a single crane 1*a* or 1*b* in an active state in the sense that it reacts to control signals which are directed at triggering a travel procedure, lifting procedure or lowering procedure and executes same. The first controller S1 and the second controller S2 are set in the individual operation corresponding to the selection as to which crane 1*a*, 1*b* is to be in the active state and which crane is to be in the passive state.

Therefore, in the individual operation, the first crane 1*a* and in particular its hoist and load picking-up means can be moved independently of and relative to the second crane 1*b* and in particular its hoist and load picking-up means. For this purpose, it is not necessary to change to the normal operation, in which each crane 1*a*, 1*b* is operated via its associated control switch 9*a*, 9*b*. As a result, the operator also does not have to alternate between the control switches 9*a*, 9*b* but instead can perform the operation continuously via one and the same control switch 9*a* or 9*b*.

The controllers S1 and S2 of the cranes 1*a*, 1*b* are designed in a decentralised manner and are divided into the modules of crane controller 2*a*, 2*b* and trolley controller 3*a*, 3*b* which in each case react in their own right to the respective control signals of the control switches 9*a*, 9*b* for switching between the normal operation and the group operation or the synchronous operation and the individual operation. Therefore, in order to switch between the normal operation and the group operation and within the group operation between the synchronous operation and the individual operation, the existing crane controller 2*a*, 2*b* and the existing trolley controller 3*a*, 3*b* are used.

As already previously mentioned, it may be necessary within the group operation to change from the synchronous operation to the individual operation in order to overcome a critical operating state achieved by the synchronous operation. For this purpose, in the individual operation at least a travel procedure, lowering procedure and/or lifting procedure is then performed as a correction movement. During the correction movement, there is a change in the distribution of the load to the hoists and load picking-up means which are involved in the group operation and support the load. This gives rise to the risk that the deactivated crane 1*a* or 1*b* not involved in the correction movement, or its hoist, becomes overloaded as a result of the correction movement, without this have to be compulsorily associated with a visually appreciable oblique position of the load. It is also feasible that even before the planned commencement of the correction movement in the individual operation the deactivated crane 1*a* or 1*b* or its hoist is overloaded. An overload can result in damage to the load picking-up means, hoist and/or can result in the load crashing, and therefore is to be prevented.

For this purpose, the present method provides the following measures. Each hoist is provided in a known manner with an overload protection device (not illustrated) having a load sensor in order to continuously determine at the respective hoist load values which correspond to a partial load acting upon the hoist and to continuously compare said load values to a respectively permissible and parameterisable threshold value. The performance of a travel procedure, lifting procedure and/or lowering procedure is prevented by the controller S1 or S2 in the event of an overload, i.e. if in the corresponding hoist a load value is determined which exceeds a permissible threshold value. This applies both to the normal operation and to the group operation.

However, in contrast to the prior art described in the introduction, in the individual operation it is not only the activated crane 1*a* or 1*b* or its hoist which is monitored with regard to a possible overload but also the deactivated crane 1*a* or 1*b* or its hoist. For this purpose, the associated controller S1 or S2 stores the previous involvement of each crane 1*a*, 1*b* or hoist in the common lifting procedure in the synchronous operation. Furthermore, the respective load values and threshold values are available to both controllers S1 and S2 via the bus 7. The threshold values can vary in dependence upon different operating situations and can be set in each case in the two controllers S1 and S2. Consequently, such operating situations which can be taken into consideration include e.g. crane or lifting gear distances which are to be maintained depending upon the load, load reductions or load limitations which are required for static reasons, or even different profiles of experience of operators. The determined load values and threshold values are compared. If an overload is present at the deactivated hoist, the corresponding controller S1 or S2 prevents the activated hoist from being able to perform a travel procedure, lifting procedure and/or lowering procedure. The travel procedure, lifting procedure and/or lowering procedure in the individual operation is accordingly stopped or cannot even be commenced at all if even before the planned commencement of the correction movement in the individual operation the deactivated crane 1*a* or 1*b* or its hoist is overloaded.

In the aforementioned cases, the load can also be lowered by implementing a change back to the synchronous operation with all of the hoists previously involved in the common lifting procedure.

Although, in the present exemplified embodiment, the invention is described with reference to a group operation comprising two cranes 1*a*, 1*b*, the previously described principle of the invention can also be easily applied to a group operation comprising more than two cranes 1*a*, 1*b*. In this case, the synchronous operation is then performed in a similar manner to the tandem operation with all of the at least three cranes which, as described above, are logged-on for the group operation and are connected together accordingly in terms of control. In this case, in the same way as described above, the second operating mode available is an individual operation, in which then only a single crane remains activated. In addition, a multi-operation also exists as the third operating mode. The synchronous operation, multiple operation or individual operation is selected likewise by actuating the selection button 12*c* accordingly. The multiple operation represents a type of "small" synchronous operation in terms of a minor synchronous operation. Accordingly, in the multi-operation at least two cranes are activated and at least one of the cranes is deactivated. All of the activated cranes can be operated in parallel and synchronously and relative to the deactivated cranes in a similar manner to the regular synchronous operation, in which all of the cranes involved in the group operation are activated. The cranes involved in the multi-operation are activated by actuating one of the button switching elements of the activated control switch 9*a* or 9*b* which is correspondingly used as an activation button 12*d*. The activation button 12*d* also serves to deactivate the cranes which, proceeding from the synchronous operation or multi-operation, are not or are no longer to be involved in the multi-operation. However, an individual operation or multi-operation following on from a synchronous operation is only possible if, as described above, an overload is not determined at a deactivated crane or its hoist. For this purpose, for each crane or hoist the involvement in the synchronous operation is likewise stored in the associated controller. After the change to the individual operation or multi-operation by the controller of the at least one activated hoist, the respectively determined load values and threshold values of all of the hoists originally involved in the synchronous operation are compared using this information, in order to prevent, in the event of an overload, a travel procedure, lifting procedure and/or lowering procedure of the at least one activated hoist. The stored information relating to the common lifting procedure in the synchronous operation or the hoists involved in this synchronous operation is deleted as soon as for all of these hoists load values are determined which exclude the overloading of the particular hoist having the lowest threshold value.

The previously described method is not restricted to the operation of cranes, of which the hoists can be moved horizontally, but basically can also be applied to the operation of lifting gears or the respectively positionally fixed hoist thereof, and during operation thereof accordingly only lifting procedures and lowering procedures, not travel procedures, are performed.

The invention claimed is:

1. A method for operating at least two lifting gears in a group operation, wherein each lifting gear has a hoist, via which a respective cable or chain can be raised by a lifting procedure or lowered by a lowering procedure to move a load, in which group operation said method comprises:

first performing in a synchronous operating mode a common lifting procedure that is carried out by the at least two hoists in order to move a load supported by the hoists;

deactivating, after the common lifting procedure, at least one of the hoists involved in the common lifting procedure to switch from the synchronous operation to an individual operation or a multi-operation, wherein at least one of the hoists involved in the common lifting procedure remains activated such that only each activated hoist can carry out a lifting procedure or lowering procedure relative to each deactivated hoist;

determining a load value for the at least one deactivated hoist previously involved in the common lifting procedure of the synchronous operation, the load value corresponding to a partial load acting upon the at least one deactivated hoist after the switch from the synchronous operation to the individual operation or the multi-operation; and comparing the determined load value to a predetermined threshold value for the at least one deactivated hoist;

wherein the lifting procedure or the lowering procedure of each activated hoist is prevented if, in the case of the at least one deactivated hoist, the load value is determined as exceeding the predetermined threshold value;

wherein the lifting procedure or the lowering procedure of each activated hoist is not prevented if, in the case of the at least one deactivated hoist, the load value is determined as not exceeding the predetermined threshold value.

2. The method as claimed in claim 1, wherein the load value for each deactivated hoist is continuously determined and compared to a respective predetermined threshold value for each deactivated hoist.

3. The method as claimed in claim 2, wherein an involvement of each hoist in the common lifting procedure synchronous operation is stored and, after switching to the individual operation or multi-operation by a controller of the at least one activated hoist, load values and threshold values of all of the hoists originally involved in the synchronous operation are compared.

4. The method as claimed in claim 3, wherein each hoist can be moved in at least one horizontal direction by a travel procedure independently of the lifting or lowering procedure and the travel procedure of each activated hoist is prevented if, in the case of the at least one deactivated hoist, the load value of the at least one deactivated hoist is determined as exceeding the predetermined threshold value of the at least one deactivated hoist; and the travel procedure of each activated hoist is not prevented if, in the case of the at least one deactivated hoist, the load value of the at least one deactivated hoist is determined as not exceeding the predetermined threshold value of the at least one deactivated hoist.

5. The method as claimed in claim 4, wherein the predetermined threshold value of the at least one deactivated hoist can vary in dependence upon different operating situations and can be set in the controller of the respective hoist.

6. The method as claimed in claim 1, wherein each lifting gear is designed as a crane comprising a crane girder.

7. The method as claimed in claim 1, wherein the lifting gears are operated together synchronously in the synchronous operation via a single control switch.

8. The method as claimed in claim 1, wherein load values for each hoist are continuously determined and compared to a respective predetermined threshold value.

9. The method as claimed in claim 8, wherein an involvement of each hoist in the common lifting procedure synchronous operation is stored and, after switching to the individual operation or multi-operation by a controller of the at least one activated hoist, load values and threshold values of all of the hoists originally involved in the synchronous operation are compared.

10. The method as claimed in claim 1, wherein an involvement of each hoist in the common lifting procedure synchronous operation is stored and, after switching to the individual operation or multi-operation by a controller of the at least one activated hoist, load values and threshold values of all of the hoists originally involved in the synchronous operation are compared.

11. The method as claimed in claim 1, wherein each hoist can be moved in at least one horizontal direction by a travel procedure independently of the lifting or lowering procedure and the travel procedure of each activated hoist is prevented if, in the case of the at least one deactivated hoist, the load value of the at least one deactivated hoist is determined as exceeding the predetermined threshold value of the at least one deactivated hoist; and the travel procedure of each activated hoist is not prevented if, in the case of the at least one deactivated hoist, the load value of the at least one deactivated hoist is determined as not exceeding the predetermined threshold value of the at least one deactivated hoist.

12. The method as claimed in claim 11, wherein the predetermined threshold value of the at least one deactivated hoist can vary in dependence upon different operating situations and can be set in a controller of the respective hoist.

13. The method as claimed in claim 1, wherein the predetermined threshold value of the at least one deactivated hoist can vary in dependence upon different operating situations and can be set in a controller of the respective hoist.

14. A method for operating at least two lifting gears in a group operation, wherein each lifting gear has a hoist, via which a respective cable or chain can be raised by a lifting procedure or lowered by a lowering procedure to move a load, in which group operation said method comprises:

first performing in a synchronous operating mode a common lifting procedure that is carried out by the at least two hoists in order to move a load supported by the hoists;

deactivating, after the common lifting procedure, at least one of the hoists involved in the common lifting procedure to switch from the synchronous operation to an individual operation or a multi-operation, wherein at least one of the hoists involved in the common lifting procedure remains activated such that only each activated hoist can carry out a lifting procedure or lowering procedure relative to each deactivated hoist;

determining a load value for each hoist previously involved in the common lifting procedure of the synchronous operation, the load value corresponding to a partial load acting upon each such hoist after the switch from the synchronous operation to the individual operation or the multi-operation; and comparing the determined load value to a respective predetermined threshold value for each hoist previously involved in the common lifting procedure;

wherein the lifting procedure or the lowering procedure of each activated hoist is prevented if, in the case of the at least one deactivated hoist, the load value is determined as exceeding the predetermined threshold value;

wherein the lifting procedure or the lowering procedure of each activated hoist is not prevented if, in the case of the at least one deactivated hoist, the load value is determined as not exceeding the predetermined threshold value.

15. The method as claimed in claim 14, wherein the load values for each hoist are continuously determined and compared to the respective predetermined threshold value.

16. The method as claimed in claim 14, wherein an involvement of each hoist in the common lifting procedure synchronous operation is stored and, after the switch to the individual operation or multi-operation by a controller of the at least one activated hoist, determined load values and threshold values of all of the hoists originally involved in the synchronous operation are compared.

17. An assembly comprising at least two cranes configured for group operation with each crane having a hoist via which a respective cable or chain can be raised by a lifting procedure or lowered by a lowering procedure to move a load, and wherein each crane includes a controller;

wherein, via said controllers, said cranes are operable in a synchronous operating mode via which a common lifting procedure is carried out by the at least two hoists in order to move a load supported by the hoists; and wherein, after the common lifting procedure, at least one of the hoists involved in the common lifting procedure is deactivated to switch from the synchronous operation to an individual operation or a multi-operation, and wherein at least one of the hoists involved in the common lifting procedure remains activated such that only each activated hoist can carry out a lifting procedure or lowering procedure relative to each deactivated hoist;

wherein, via at least one of said controllers, a load value for the at least one deactivated hoist previously involved in the common lifting procedure of the synchronous operation is determined, the load value corresponding to a partial load acting upon the at least one deactivated hoist after the switch from the synchronous operation to the individual operation or the multi-operation, and wherein the determined load value is compared to a predetermined threshold value for the at least one deactivated hoist; and wherein, via at least one of said controllers, the lifting procedure or the lowering procedure of each activated hoist is prevented if, in the case of the at least one deactivated hoist, the load value is determined as exceeding the predetermined threshold value;

wherein, via at least one of said controllers, the lifting procedure or the lowering procedure of each activated hoist is not prevented if, in the case of the at least one deactivated hoist, the load value is determined as not exceeding the predetermined threshold value.

* * * * *